US006637920B2

(12) United States Patent
Murakoshi et al.

(10) Patent No.: US 6,637,920 B2
(45) Date of Patent: Oct. 28, 2003

(54) VEHICULAR LAMP HAVING IMPROVED LUMINANCE OF TINTED LIGHT

(75) Inventors: Mamoru Murakoshi, Shizuoka (JP); Shigeki Ono, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/818,526

(22) Filed: Mar. 28, 2001

(65) Prior Publication Data

US 2001/0026456 A1 Oct. 4, 2001

(30) Foreign Application Priority Data

Mar. 28, 2000 (JP) ..... P.2000-088129

(51) Int. Cl.[7] ..... F21V 7/00

(52) U.S. Cl. ..... 362/516; 362/346; 362/806; 362/293; 362/307

(58) Field of Search ..... 362/300, 341, 362/346, 351, 806, 516, 293, 296, 307; 313/635

(56) References Cited

U.S. PATENT DOCUMENTS

| | | | | | |
|---|---|---|---|---|---|
| 2,261,001 | A | * | 10/1941 | Muldoon | 240/10.6 |
| 3,397,335 | A | * | 8/1968 | Peek | 313/111 |
| 3,639,748 | A | * | 2/1972 | Pearson et al. | 240/7.1 G |
| 3,988,160 | A | * | 10/1976 | Trexel | 106/1.12 |
| 4,213,170 | A | * | 7/1980 | Kimball et al. | 362/267 |
| 4,888,635 | A | * | 12/1989 | Harada et al. | 358/75 |
| 5,010,458 | A | | 4/1991 | Fraizer | 362/80 |
| 5,130,904 | A | | 7/1992 | Ohshio et al. | 362/61 |
| 5,285,358 | A | * | 2/1994 | Watanabe et al. | 362/61 |
| 5,521,798 | A | * | 5/1996 | Bertling et al. | 362/61 |
| 5,752,761 | A | * | 5/1998 | Pietruczynik et al. | 362/84 |
| 5,882,796 | A | * | 3/1999 | Wilson et al. | 428/411.1 |
| 5,921,672 | A | * | 7/1999 | Dobler et al. | 362/538 |
| 5,945,775 | A | | 8/1999 | Ikeda et al. | 313/113 |
| 2002/0024817 | A1 | * | 2/2002 | Reiss | |

FOREIGN PATENT DOCUMENTS

| | | | | |
|---|---|---|---|---|
| EP | 0 860 652 A2 | | 8/1998 | F21Q/1/00 |
| EP | 0 922 903 A2 | | 6/1999 | F21Q/1/00 |
| GB | 277250 | | 9/1927 | |
| GB | 2 237 370 A | | 5/1991 | F21M/3/02 |
| JP | 2-18202 | | 2/1990 | F21M/3/08 |
| JP | 09241547 A | * | 9/1997 | C09D/5/00 |

* cited by examiner

*Primary Examiner*—Stephen Husar
*Assistant Examiner*—Sharon Payne
(74) *Attorney, Agent, or Firm*—Sughrue Mion, PLLC

(57) ABSTRACT

A vehicular lamp having an improved luminous intensity of reflected light that has passed through a tinted topcoat layer. Light emitted from a light source bulb is reflected by a reflector to form an outward beam. The reflector is formed of an effective reflector portion contributing to formation of the outward beam and a non-effective reflector portion not contributing to formation of the outward beam. Only the non-effective reflector portion or only the non-effective reflector portion and an extension portion are coated with a tinted topcoat layer. The particle diameter of pigments dispersed in the tinted topcoat layer is limited to a certain range.

11 Claims, 6 Drawing Sheets

FIG.5

| Broad classification | Pigment | Test results | | | | | | | Evaluation |
|---|---|---|---|---|---|---|---|---|---|
| | | Outer Appearance | Weather resistance | Heat resistance | Water resistance | Acid resistance | Alkali resistance | Chemical resistance | |
| Organic pigment | Phthalocyanine blue | ◎ | ◎ | ◎ | ◎ | ◎ | ◎ | ◎ | ◎ |
| | Indanthrene blue | ◎ | ◎ | ◎ | ◎ | ◎ | ◎ | ○ | ○ |
| Inorganic pigment | Cobalt blue | ◎ | ◎ | ◎ | ◎ | ◎ | ◎ | ◎ | ◎ |
| | Dark blue | △ | △ | ○ | × | ◎ | × | ○ | × |
| | Ultramarine blue | ◎ | ◎ | ○ | ◎ | × | ◎ | ○ | × |

VEHICULAR LAMP HAVING IMPROVED LUMINANCE OF TINTED LIGHT

BACKGROUND OF THE INVENTION

The present invention relates to a vehicular lamp of a type wherein light emitted from a light source bulb is reflected by a reflector to form an outward illuminating light beam. More particularly, the invention relates to such a vehicular lamp in which the reflector is coated with a tinted topcoat layer so as to allow for discrimination from the outer appearance of the vehicular lamp as to whether the lamp is in its ON or OFF state, and for brightening the outward light beam when the lamp is in the ON state.

In a vehicular lamp such as headlamp mounted on an automobile or a two-wheeled vehicle, the technique of reflecting light emitted by a light source bulb with a reflector to form an outward light beam has of course long been well known. In such a lamp, tinting the topcoat layer formed as the outermost layer of the reflecting surface has been conventionally employed both to protect the reflecting surface, which is formed on the upper layer of a lamp body by aluminum deposition, and to change the color of the emitted light.

This technique has been developed based on the phenomenon that when the light emitted from a light source bulb passes through the tinted topcoat layer, light having a specific wavelength is absorbed, so that the color of the reflected light is determined in dependence on the pigment contained in the tinted topcoat layer. Such a lamp is disclosed in Japanese Utility Model Laid-open Publication No. Hei. 2-18202.

According to this technique, for example, if a coating layer containing a blue-based pigment is used as the topcoat layer, in the ON state of the lamp while in use at night, the reddish light emitted by an incandescent bulb can be converted into, for example, white light, similar to the light emitted from a halogen bulb, or white light emitted from a halogen bulb can be converted into the pale blue light typical of a discharge lamp. Therefore, it is possible to facilitate visibility at longer distances and to provide an improved outer appearance for the lamp.

In addition to the above effects obtained when the lamp is in the ON state, in the OFF state during the daytime the tinted topcoat layer of the reflector causes the natural light reflected outward from the lamp chamber to give the lamp a distinctive appearance.

However, in such a lamp a certain portion of the light emitted from the bulb is absorbed due to the passage of the light through the tinted topcoat layer. As a result, the luminous intensity is reduced, causing a problem in light distribution.

If the density of the pigment of the tinted topcoat layer is increased so as to improve the outer appearance of the lamp, the reflection factor of the lamp is decreased, thus further reducing the luminous intensity of the lamp. It has been difficult in the conventional art to satisfy simultaneously the requirements of an improved outer appearance and high luminous efficiency.

FIG. 1 is a vertical sectional view of a vehicular lamp (headlamp) having a reflector provided behind a halogen bulb. The structure of the vehicular lamp 1 will be explained referring to the drawing.

The lamp 1 is formed with generally a cup-like shape. The lamp 1 includes a lamp body 2 with its rear top portion 2*a* provided with an opening 11 for mounting a light source bulb (halogen bulb) 3, a rubber boot 8 having a predetermined shape for sealing the opening 11, the light source bulb 3 disposed in a lamp chamber 4 inside the lamp body 2, and a front lens 10 mounted so as to close the front opening of the lamp body 2.

The reflector 5 includes a reflecting surface 504 (see FIG. 2) for reflecting bulb-emitted light $P_1$ from the light source bulb 3 forward of the vehicle to form an outward illuminating beam $P_2$. An extension portion (extension reflector) 6 is also provided for covering a gap 7 formed between the reflector 5 and the lamp body 2.

Reference numeral 301 represents a top portion which is painted black for shielding the forward light from the light source bulb 3. In some cases, a shade member (not shown) having the same outer appearance color as that of the reflector 5 may be provided around the light source bulb 3.

In addition to FIG. 1, referring to FIG. 2, which is a partial sectional view of the reflector 5, the structure of the reflector 5 will be explained in detail.

The reflector 5 generally has a four-layer structure including a synthetic resin base body 501 defining the basic shape of the reflector 5, an undercoat layer 502 provided on the upper layer of the base body 501 for smoothing any roughness in the surface of the base body 501, a reflecting surface 504 including a surface formed by an aluminum-deposited layer 503 and provided on an upper layer of the undercoat layer 502, and a topcoat layer 505 for protecting the reflecting surface 504.

The reflector otherwise can be formed as a three-layer structure by omitting the undercoat layer 502.

The reflector 5 has substantially a cup-shaped outer appearance. The reflector 5 is provided with a paraboloidal effective reflector portion (effective reflecting surface) 5*x* (see FIG. 1) which can effectively contribute to formation of the reflected light $P_2$, and a non-effective reflector portion (non-effective reflecting surface) 5*y* having an extension wall (flat plate-like surface) extending from the end of the effective reflector portion 5*x* toward the front lens 10. The non-effective reflector portion 5*y* does not directly contribute to the formation of the reflected light $P_2$ but is required for structural or design reasons.

Since one of the purposes of the topcoat layer of the reflector 5 is to protect the reflecting surface 504, it is required that the bulb-emitted light $P_1$ pass through the topcoat layer without greatly lowering its luminous intensity, while reflected light (outward emitted light) $P_2$ having a desired light distribution is formed on the reflecting surface 504, i.e., the transparent topcoat layer (not shown).

Recently, it has been proposed to form a transparent topcoat layer by "smoke coating" (also called "color clear coating") wherein a pigment 505*a* is dispersed in a base medium to form a tinted topcoat layer 505. With this reflected light coloring technique, the reflected light $P_2$ is converted into colored reflected light while reducing the amount by which the luminous intensity of the reflected light $P_2$ is lowered due to coloring.

For carrying out this reflected light coloring technique, there has been proposed a method for forming a five-layered structure wherein smoke coating is performed on an upper layer of a transparent topcoat layer in a separate step. However, since the number of steps is increased with such a technique, a method for combining the topcoat layer with the tinted topcoat layer 505 so as to not increase the number of layers is generally preferred.

With the reflected light coloring technique, by forming the tinted topcoat layer 505 as a blue coated layer, when the lamp is turned ON at night, the light $P_1$ from the light source bulb (halogen bulb) 3 is converted into colored reflected light of a pale blue color or the like, similar to the light from a discharge-type bulb. Also, using this technique the reddish light from an incandescent bulb can be converted into substantially white reflected light, similar to the light from a halogen bulb.

Thus, the reflected light coloring technique has merit in that it prevents a large reduction in the brightness of the light from the lamp 1, preserving visibility over long distances, while enhancing the outward appearance of the lamp, without having to employ an expensive light source.

When the lamp is in the OFF state, due to the provision on the reflector 5 of the tinted topcoat layer 505, light $P_3$ entering from outside the light chamber 4 is tinted. Therefore, the outer design of the lamp 1 can be distinguished in terms of coloration, and the visual recognition ability of the vehicle in the evening can be enhanced.

However, in the conventional reflected light coloring technique, the tinted topcoat layer 506 is formed over the entire reflector 5, i.e., over both the effective reflector portion 5*x* and the non-effective reflector portion 5*y*. With this arrangement, although the luminous intensity of the reflected light formed by the effective reflector portion 5*x* is generally acceptable in terms of overall light distribution, it is lowered somewhat due to the presence of the tinted topcoat layer 505. Therefore, visibility over longer distances is lowered, and the overall quality of the lamp is reduced.

SUMMARY OF THE INVENTION

It is an object of the present invention to provide a vehicular lamp which avoids the problem of lowered luminous intensity of outside light reflected by the lamp.

To achieve the above and other objects, the invention provides a vehicular lamp in which light emitted from a light source bulb is reflected by a reflector to form an outward light beam wherein the reflector is formed of a paraboloidal effective reflector portion contributing to formation of the outward-emitted light and a non-effective reflector portion formed as an extension wall to satisfy structural or design requirements but not contributing to the formation of the outward illuminating light beam, and only the non-effective reflector portion is coated with a tinted topcoat layer.

With this structure, in the ON state of the lamp the bulb-emitted light is reflected by the effective reflector portion not coated with a tinted topcoat layer to form the outward beam. Therefore, the problem of reduced light distribution due to a reduction in luminous intensity is avoided, although the reflected light of the outward beam cannot be colored.

In the OFF state of the lamp, tinting is added to the outside reflected light by the non-effective reflector portion provided with the tinted topcoat layer. The design of the vehicular lamp thus can be uniquely distinguished.

In an embodiment of the invention in which the reflector is provided separately from the lamp body and an extension portion is disposed in the vicinity of a front lens for covering a gap formed between the reflector and the lamp body, only the extension portion is provided with a tinted topcoat layer.

In another embodiment where the reflector is provided separately from the lamp body, the reflector is formed of an effective reflector portion contributing to formation of the outward beam and a non-effective reflector portion not contributing to formation of the outward beam, and an extension portion is disposed in the vicinity of the front lens for covering a gap formed between the reflector and the lamp body, and each of the non-effective reflector portion and the extension portion is coated with a tinted topcoat layer. In this case, the entire lamp chamber (the entire inner side of the front lens) appears in a desired color.

The coloration of the reflected light largely depends on the dispersion state of pigments in the tinted topcoat layer, and the dispersion state of the pigments is affected by the particle diameter. Considering the aforementioned facts, the desired coloration of the reflected light is obtained by limiting the particle diameter of the pigments within a certain range. More specfically, the diameter of the pigment particles dispersed in the tinted topcoat layer is preferably in a range from 0.01 to 0.5 $\mu$m, more preferably 0.04 to 0.12 $\mu$m. By limiting the particle diameter of the pigments within this range, it is possible simultaneously to satisfy the requirements of both coloring and concealment (transparency).

At least one of a phthalocyanine-based pigment and a cobalt-based pigment may be employed. Both phthalocyanine-based pigment and cobalt-based pigment provide vivid coloration as well as excellent weather resistance, heat resistance and corrosion resistance.

The luminous intensity of the reflected light depends on the reflection factor, which in turn depends on the density of the pigment which determines the shielding of the reflecting surface. Since the luminous intensity of the reflected light can be controlled by adjusting the relative amount of pigment, the relative amount of the phthalocyanine-based pigment in the coloring paint used for forming the tinted topcoat layer is preferably set in the range from 0.04 to 0.12 wt %, more preferably 0.05 to 0.10 wt %.

As described above, the present invention is capable of not only solving the problem of a decrease in the luminous intensity of the reflected light (outward beam) that has passed through the tinted topcoat layer, but also causing the reflected light appear to be in a desired color. Therefore, the present invention is significant in providing a vehicular lamp exhibiting good light distribution performance and excellent outer appearance.

BRIEF DESCRIPTION OF THE DRAWINGS

FIG. 5 is table of data of resistance tests by pigments of the tinted topcoat layer.

DESCRIPTION OF THE PREFERRED EMBODIMENTS

Preferred embodiments of the present invention will be explained with reference to the accompanying drawings.

In accordance with the present invention, the inventors have dispensed with the conventional approach wherein the tinted topcoat layer 505 is provided over the entire reflector 5, and providing a lamp 1 wherein there is no decrease in the luminous intensity of the outward illuminating beam.

Figure 3:
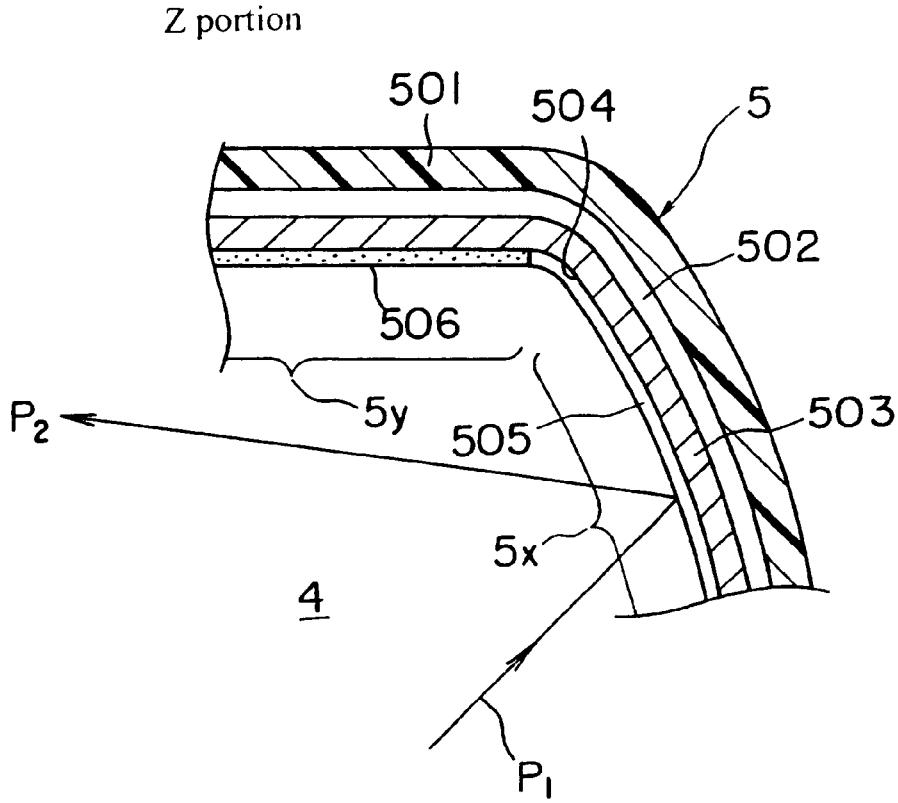
FIG. 3 is an enlarged sectional view of a boundary portion Z between an effective reflector portion 5*x* and a non-effective reflector portion 5*y*.

As shown in FIG. 3, which is an enlarged sectional view of a boundary portion Z (denoted in FIG. 1) between the effective reflector portion 5*x* and the non-effective reflector portion 5*y*, in accordance with a first embodiment of the invention only the non-effective reflector portion 5*y* of the reflector 5 is coated with the tinted topcoat layer 506, and the effective reflector portion 5*x* is provided with a transparent topcoat layer which is not colored.

Figure 1:
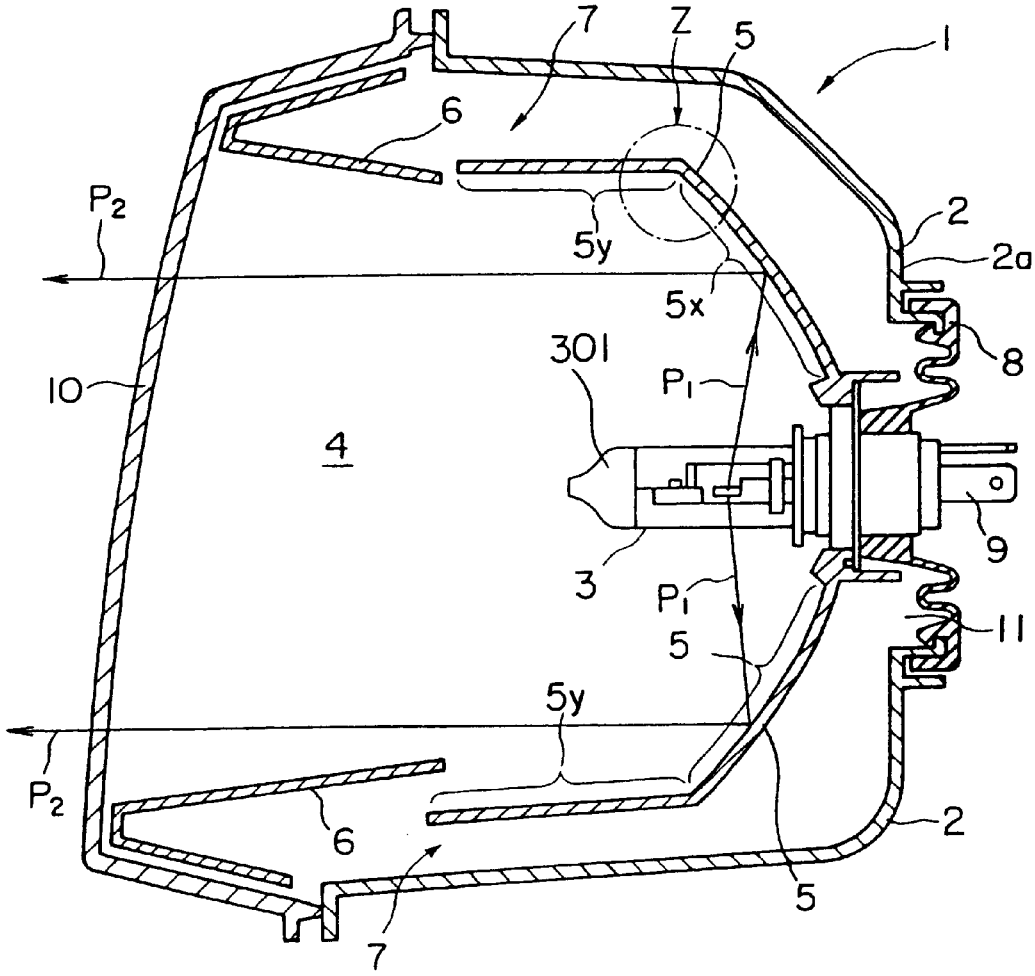
FIG. 1 is a vertical sectional view of a vehicular lamp provided with a reflector and a halogen bulb as a light source.

The structure of this embodiment can be applied not only to a lamp having in which the lamp body 2 and the reflector 5 are provided as separate members as shown in FIG. 1, but also to a lamp in which the reflector is integrally formed on the inner surface of the lamp body. The present invention can be applied so long as the reflector has both an effective reflector portion 5*x* and a non-effective reflector portion 5*y*.

According to the above-described embodiment, in the ON state of the light source bulb 3, the reflected light $P_2$ is not colored. However, there is no decrease in the luminous intensity of the reflected light $P_2$ of the lamp 1, thus eliminating adverse influences on the light distribution.

In the OFF state of the lamp, color is added to the reflected light $P_4$ derived from the light $P_3$ incident from outside into the lamp chamber 4. The outward appearance of the lamp 1 thus can be distinguished in terms of coloration.

Therefore, according to the above-described embodiment, although the light $P_1$ from the light source bulb 3 is not tinted, it is possible to reliably meet the requirement of distinguishing the coloration of the lamp 1 in the OFF state of the lamp 1.

Further, in accordance of a second embodiment of the invention, namely, in the case of a lamp 1 in which an extension portion 6 as shown in FIG. 1 is provided, the extension portion 6 may be coated with the tinted topcoat layer 506, in addition to the non-effective reflector portion 5*y*.

According to the second embodiment, it is possible to tint the bulb-emitted light $P_1$, so that when the lamp 1 is observed from the outside in the OFF state of the lamp, the entire inside of the light chamber 4 assumes a desired coloration, which is especially preferable in terms of design.

Further, in a third embodiment of the invention, only the extension portion 6 is provided with the tinted topcoat layer 506. According to this embodiment, when the lamp 1 is observed in the OFF state, the outside reflected light incident on the colored extension portion 6 appears to be colored, thus distinguishing the lamp 1 by its coloration.

There is no particular need to add coloration to the outward emitting light $P_1$. However, it is possible to reliably meet, with simple means, the requirement that the outer appearance of the lamp 1 is colored so as to enhance the overall appearance of the lamp.

In a fourth embodiment of the invention, the light derived from the source bulb 3 is tinted, while the coloration of the lamp 1 in its OFF state is distinguished in terms of overall appearance.

In this embodiment, in the reflector 5 of the lamp 1, at least the effective reflector portion 5*x* is provided with the tinted topcoat layer 505 so that desired coloration is added to the bulb-emitted light $P_1$ in the ON state of the lamp, while the particle diameter of the pigment 505*a* dispersed in the tinted topcoat layer 505 is limited within a predetermined range.

Figure 4:
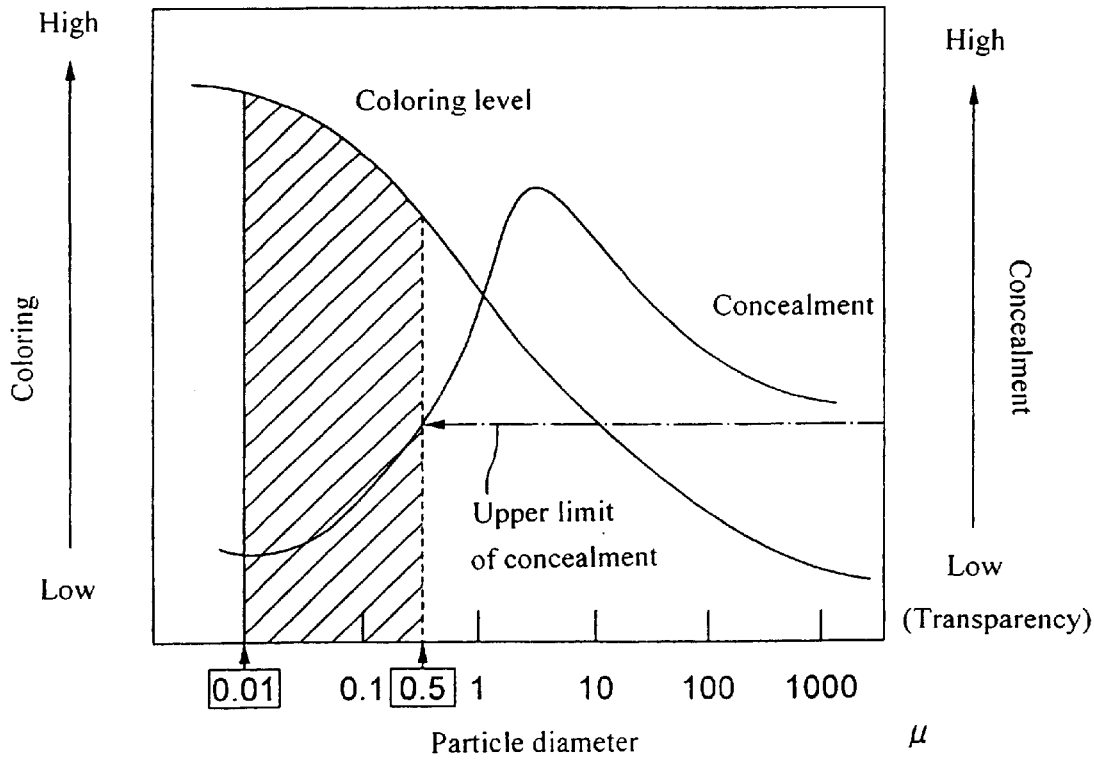
FIG. 4 is a graph showing the correlation among particle diameter, coloring performance and concealment factor of the pigments dispersed and included in a tinted topcoat layer.

FIG. 4 is a graph showing the correlation among the particle diameter, coloring performance and concealment factor (transparency or light shielding factor) of the pigment 505*a* dispersedly contained in the tinted topcoat layer 505. As shown in FIG. 4, as the particle diameter is decreased, the coloring degree becomes higher (coloration becomes stronger), which is preferable in terms of overall design. To the contrary, as the particle diameter is increased, the coloring degree is gradually reduced, which is not preferable in terms of design.

As for the concealment factor, when the particle diameter of the pigment exceeds 10 $\mu$m, the average gap between particles becomes greater, and the amount of visible light passing through the gap is increased (the concealment factor is lowered). However, if the particle diameter is in the range of about 5 to 10 $\mu$m, the average gap length between particles becomes smaller, thus reducing the amount of visible light passing through the gap (the concealment factor is increased).

If the concealment factor is high, the reflecting surface 504 under the tinted topcoat layer 505 becomes obscured (concealed). As a result, the reflection coefficient and hence the luminous intensity are lowered, and radiance (glittering) or metallic coloration of the reflecting surface 504 is lost. If the particle diameter is too small, the wavelength of the visible light becomes greater with respect to the particle diameter, dispersion or diffraction of the light occurs. This may allow passage of light having a purple to green component.

The inventors carried out tests to determine the particle diameter of the pigment 505*a* capable of satisfying both the coloring degree and concealment factor requirements, and found that it ranged from 0.01 to 0.5 $\mu$m (shaded region in FIG. 4).

If the particle diameter of the pigment 505*a* is smaller than 0.01 $\mu$m, the coloring degree reaches its upper limit and there is no advantageous effect to be gained by further reducing the particle diameter of the pigment, while the concealment factor reaches its upper limit. On the other hand, if the particle diameter exceeds 0.5 $\mu$m, the required coloring degree and concealment factor cannot be obtained. That is, the resultant coloration is insufficient and the desired radiance cannot be obtained.

Further, the tinted topcoat layer 505 is required to have weather resistance, heat resistance, water resistance, acid resistance, alkali resistance and corrosion resistance, in addition to an excellent outer appearance.

Accordingly, the inventors studied the various resistances of the pigment 505*a* when forming a blue topcoat layer, and found that, in accordance with a fifth embodiment of the invention, it is especially preferable to use an organic phthalocyanine-based pigment, which is a blue pigment, or an inorganic cobalt pigment.

FIG. 5 shows a table of data from resistance tests performed on pigments of the tinted topcoat layer 505. As shown in FIG. 5, a tinted topcoat layer 505 using phthalocyanine-based pigment is superior in chemical resistance to indanthrene blue pigment as the organic pigment. If inorganic cobalt blue pigment is used, the same effect is obtained. In FIG. 5, ◎ indicates excellent results, ○ substantially good, Δ substantially a failure, and X failure.

Therefore, if a blue topcoat layer is used as the tinted topcoat layer 505 in the first or second embodiment, it is preferable to use at least one of the phthalocyanine-based pigment and the cobalt blue pigment.

Figure 2:
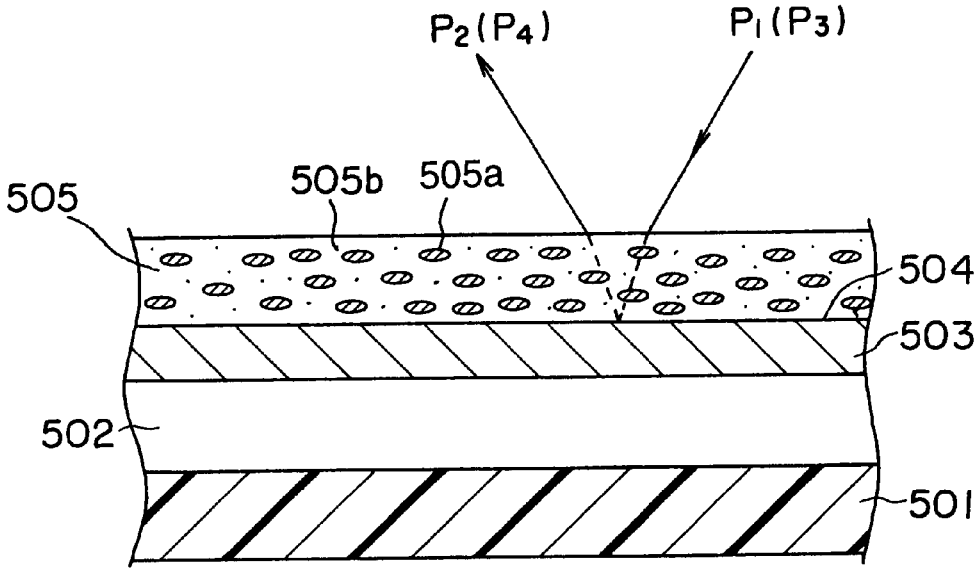
FIG. 2 is a partial sectional view of the reflector shown in FIG. 1.

A cellulose-based dispersing agent is suitable as a pigment dispersing agent 505*b* (see FIG. 2) mixed in the pigment for dispersing the phthalocyanine-based pigment.

Vinyl butyl-based dispersing agents, vinyl chloride-based dispersing agents, and rosin ester-based dispersing agents are inferior in low solubility.

The luminous intensity of the reflected light $P_2$ depends on the reflection factor, which in turn depends on the relative amount of the pigment which determines the shielding degree of the reflecting surface. Based on the fact that the luminous intensity of the reflected light $P_2$ can be controlled and adjusted by the relative amount of pigment, the inventors carried out experiments to determine the appropriate relative amount of the phthalocyanine-based pigment in the coloring paint in view of the outward appearance of the lamp in addition to luminous intensity.

Figure 6:
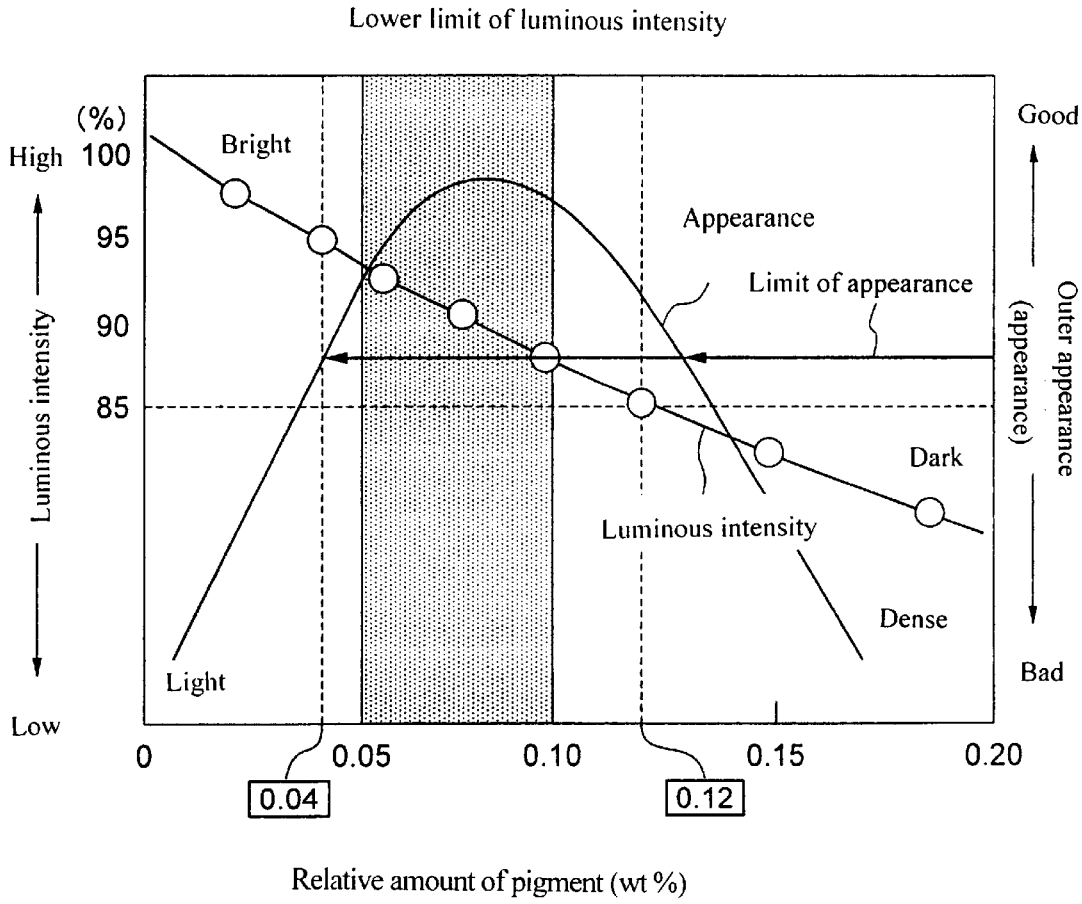
FIG. 6 is a table showing the correlation among relative amount of pigment, luminous intensity and appearance.

FIG. 6 is a table showing the correlation among the relative amount of pigment, luminous intensity and appearance. The luminous intensity indicated on the left vertical axis indicates the relative reflection factor when the reflection factor of a non-colored transparent topcoat layer (film thickness of 4 to 6 $\mu$m) is defined as 100. The outer appearance indicated on the right vertical axis is an indication as to Whether the coloration with variation of the relative amount of pigment is judged as good or bad under visual observation.

As shown in FIG. 6 representing the experimental results, the luminous intensity is gradually reduced as the relative amount of pigment increases, reaching its limit (luminous intensity 85%) at a relative amount of 0.12 wt %. The outer appearance is judged as being inferior (bad) if the relative amount of pigment is too low or too high, reaches the optimal value at a relative amount of about 0.08 wt %, and reaches the lower limit at a relative amount of 0.04 wt %.

Therefore, it is preferable td set the relative amount of pigment in a range of 0.04 to 0.12 wt %, and more preferably in a range of 0.05 to 0.10 wt %, so that requirements of both luminous intensity and outer appearance are satisfied.

According to the present invention, in a vehicular lamp in which reflected light emitted from a light source bulb is reflected by a reflector to form an outward beam, the reflector is formed of an effective reflector portion (effective reflecting surface) contributing to formation of the outward beam and a non-effective reflector portion (non-effective reflecting surface) not contributing to formation of the outward beam. Only the non-effective reflector portion is coated with a tinted topcoat layer. The problem of the conventional reflected light coloring technique concerning deterioration of the light distribution due to decreased luminous intensity is therefore avoided. In the OFF state of the lamp, it is possible to add coloration to the outside reflected light by the non-effective reflector portion provided with the tinted topcoat layer. The vehicular lamp can be distinguished in design, while securing the desired light distribution performance.

In a vehicular lamp having the reflector separate from the lamp body, only the extension portion is coated with the tinted topcoat layer. As a result, the vehicular lamp can be easily and inexpensively distinguished in design.

Coating both the non-effective reflector portion and the extension with the tinted topcoat layer makes it possible to have the entire lamp chamber (entire inner side of the front lens) appear in the desired color in the OFF state of the lamp. Thus, the vehicular lamp can be distinguished in coloration design.

When the particle diameter of pigments dispersed in the tinted topcoat layer is in a range from 0.01 to 0.5 $\mu$m, the requirements of coloring and concealment (transparency) can be satisfied. The resultant colored reflected light is capable of providing sufficient coloration and radiance (glitter effect).

When at least one of phthalocyanine-based pigment and cobalt-based pigment is dispersed in the tinted topcoat layer, it is possible to provide a vehicle having vivid coloration, as well as excellent weather resistance, heat resistance and chemical resistance.

If the relative amount of the phthalocyanine-based pigment in coloring paint is in a range of 0.04 to 0.12 wt %, it is possible to satisfy the requirements of luminous intensity and the appearance.

What is claimed is:

1. A vehicular lamp comprising:

a light source bulb;

a reflector reflecting light from said light source bulb and light from outside said lamp, said reflector comprising an effective reflector portion contributing to formation of an outward beam and a non-effective reflector portion not contributing to formation of said outward beam; and a tinted topcoat layer formed only on said non-effective reflector portion, wherein said topcoat layer is transparent so that light emitted from said bulb passes through said topcoat layer.

2. A vehicular lamp comprising:

a lamp body;

a front lens attached to said lamp body;

a light source bulb;

a reflector formed separately from said lamp body, mounted within said lamp body, and reflecting light from said light source bulb and light from outside said lamp;

an extension portion disposed adjacent said front lens for covering a gap formed between said reflector and said lamp body, said extension portion having a reflective surface; and a tinted topcoat layer formed only on said extension portion.

3. A vehicular lamp comprising:

a lamp body;

a front lens attached to said lamp body;

a light source bulb;

a reflector formed separately from said lamp body, mounted within said lamp body, and reflecting light from said light source bulb and light from outside said lamp, said reflector comprising an effective reflector portion contributing to formation of an outward beam from said lamp and a non-effective reflector portion not contributing to formation of said outward beam;

an extension portion disposed adjacent said front lens for covering a gap formed between said reflector and said lamp body, said extension portion having a reflective surface; and a tinted topcoat layer formed only on said non-effective reflector portion and on said reflective surface of said extension portion, wherein said topcoat layer is transparent so that light emitted from said bulb passes through said topcoat layer.

4. The vehicular lamp according to any one of claims 1 to 3, wherein said tinted topcoat layer comprises at least one pigment dispersed therein having a particle diameter in a range from 0.01 to 0.5 $\mu$m.

5. The vehicular lamp according to claim 4, wherein said pigment comprises at least one of a phthalocyanine-based pigment and a cobalt-based pigment.

6. The vehicular lamp according to claim 4, wherein said pigment comprises a phthalocyanine-based pigment, and wherein said tinted topcoat layer comprises a cellulose-based dispersing agent.

7. The vehicular lamp according to claim 5, wherein said pigment comprises said phthalocyanine-based pigment, and where a relative amount of said phthalocyanine-based pigment is in a range from 0.04 to 0.12 wt %.

8. The vehicular lamp according to claim 5, wherein said pigment comprises said phthalocyanine-based pigment, and where a relative amount of said phthalocyanine-based pigment is in a range from 0.05 to 0.10 wt %.

9. The vehicular lamp according to claim 2, wherein the extension portion has a free end which is spaced apart from said lamp body.

10. The vehicular lamp according to claim 3, wherein the extension portion has a free end which is spaced apart from said lamp body.

11. The vehicular lamp according to claim 2, wherein said topcoat layer is transparent so that light emitted from said bulb passes through said topcoat layer.

* * * * *